US009724614B2

(12) United States Patent
Karsten et al.

(10) Patent No.: US 9,724,614 B2
(45) Date of Patent: Aug. 8, 2017

(54) TOY WITH CONVERTIBLE TAIL

(71) Applicants: Lisa McCue Karsten, Annapolis, MD (US); Kenneth Stephen Karsten, Jr., Annapolis, MD (US)

(72) Inventors: Lisa McCue Karsten, Annapolis, MD (US); Kenneth Stephen Karsten, Jr., Annapolis, MD (US)

( * ) Notice: Subject to any disclaimer, the term of this patent is extended or adjusted under 35 U.S.C. 154(b) by 0 days.

(21) Appl. No.: 15/043,943

(22) Filed: Feb. 15, 2016

(65) Prior Publication Data

US 2016/0236104 A1 Aug. 18, 2016

Related U.S. Application Data

(60) Provisional application No. 62/116,316, filed on Feb. 13, 2015, provisional application No. 62/116,317, filed on Feb. 13, 2015.

(51) Int. Cl.

| | |
|---|---|
| ***A63H 3/00*** | (2006.01) |
| ***A63H 3/14*** | (2006.01) |
| ***A63H 3/02*** | (2006.01) |
| ***A63H 3/16*** | (2006.01) |

(52) U.S. Cl.

CPC ..... *A63H 3/14* (2013.01); *A63H 3/005* (2013.01); *A63H 3/02* (2013.01); *A63H 3/16* (2013.01)

(58) Field of Classification Search

CPC . A63H 3/02; A63H 3/52; A63H 33/00; A63H 33/003; A63H 33/005; A45F 3/02; A45F 3/14; B65D 33/06; B65D 33/105

See application file for complete search history.

(56) References Cited

U.S. PATENT DOCUMENTS

| | | | | | |
|---|---|---|---|---|---|
| 1,691,905 | A | * | 11/1928 | Gamble | A45C 11/02 206/8 |
| D129,750 | S | * | 9/1941 | Blake | 150/108 |
| 2,347,405 | A | * | 4/1944 | Ford | A63H 3/02 446/369 |
| 2,788,040 | A | * | 4/1957 | Hullweck | A45C 13/18 150/110 |
| 4,776,049 | A | | 10/1988 | Perron | |
| 5,374,192 | A | * | 12/1994 | Marble | G09B 19/00 210/505 |
| 5,749,764 | A | | 5/1998 | Bailey | |
| 5,881,932 | A | * | 3/1999 | Wadden | A45F 3/04 150/108 |
| 5,975,392 | A | * | 11/1999 | Miller | A45F 3/04 224/153 |
| 6,056,618 | A | * | 5/2000 | Larian | A63H 3/003 446/268 |
| 6,173,450 | B1 | * | 1/2001 | Hari | A41D 1/00 2/69 |

(Continued)

*Primary Examiner* — Aarti B Berdichevsky
*Assistant Examiner* — Urszula M Cegielnik
(74) *Attorney, Agent, or Firm* — 24IP Law Group; Timothy R DeWitt

(57) ABSTRACT

A plush toy having a body, removable features, a zippered pocket for storing the removable features, and a tail. The tail may be retracted into the zippered pocket through holes in the body of the toy leaving only a small portion of the tail external to the body or may be extended from the body. The tip of the tail has a clip that may be connected to a receiving member on the exterior of the body such that the extended tail clipped to the body forms a pair of backpack straps.

9 Claims, 7 Drawing Sheets

(56) References Cited

U.S. PATENT DOCUMENTS

| | | | | |
|---|---|---|---|---|
| 7,160,028 | B1 * | 1/2007 | Linday | A45C 9/00 150/108 |
| 8,092,087 | B2 * | 1/2012 | Simhony | A45C 13/30 150/108 |
| 8,721,385 | B2 | 5/2014 | Karsten et al. | |
| 8,827,760 | B2 * | 9/2014 | Ushibo | A63H 3/003 446/268 |
| 2003/0077978 | A1 * | 4/2003 | Beige | A63H 3/005 446/369 |
| 2006/0089076 | A1 * | 4/2006 | Jacobson | A63H 3/005 446/71 |
| 2006/0205319 | A1 * | 9/2006 | Colvin | A63H 3/005 446/369 |
| 2007/0072513 | A1 * | 3/2007 | Rothmiller | A63H 3/02 446/369 |
| 2007/0232186 | A1 * | 10/2007 | Shamah | A63H 3/005 446/369 |
| 2014/0349549 | A1 | 11/2014 | Karsten et al. | |

* cited by examiner

TOY WITH CONVERTIBLE TAIL

CROSS-REFERENCE TO RELATED APPLICATIONS

The present application claims the benefit of the filing date of U.S. Provisional Patent Application Ser. No. 62/116,316 and U.S. Provisional Patent Application Ser. No. 62/116,317, both filed by the present inventors on Feb. 13, 2015.

The aforementioned provisional patent application is hereby incorporated by reference in its entirety.

STATEMENT REGARDING FEDERALLY SPONSORED RESEARCH OR DEVELOPMENT

None.

BACKGROUND OF THE INVENTION

Field of the Invention

The present invention relates to relates to toys, and more particularly, to plush toys having multiple configurations.

Brief Description of the Related Art

A wide variety of plush toys, puppets and toy purses are known in the toy industry. Example includes the toys disclosed by the present inventors in U.S. Pat. No. 8,721,385 and U.S. Patent Application Publication No. 2014/0349549, which are hereby incorporated by reference.

SUMMARY OF THE INVENTION

In a preferred embodiment, the present invention is a plush toy having a body, removable features, a zippered pocket for storing the removable features, and a tail. The tail may be retracted into the zippered pocket through holes in the body of the toy leaving only a small portion of the tail external to the body or may be extended from the body. The tip of the tail has a clip that may be connected to a receiving member on the exterior of the body such that the extended tail clipped to the body forms a pair of backpack straps.

Still other aspects, features, and advantages of the present invention are readily apparent from the following detailed description, simply by illustrating a preferable embodiments and implementations. The present invention is also capable of other and different embodiments and its several details can be modified in various obvious respects, all without departing from the spirit and scope of the present invention. Accordingly, the drawings and descriptions are to be regarded as illustrative in nature, and not as restrictive. Additional objects and advantages of the invention will be set forth in part in the description which follows and in part will be obvious from the description, or may be learned by practice of the invention.

BRIEF DESCRIPTION OF THE DRAWINGS

For a more complete understanding of the present invention and the advantages thereof, reference is now made to the following description and the accompanying drawings, in which.

DETAILED DESCRIPTION OF THE PREFERRED EMBODIMENTS

Figure 1A:
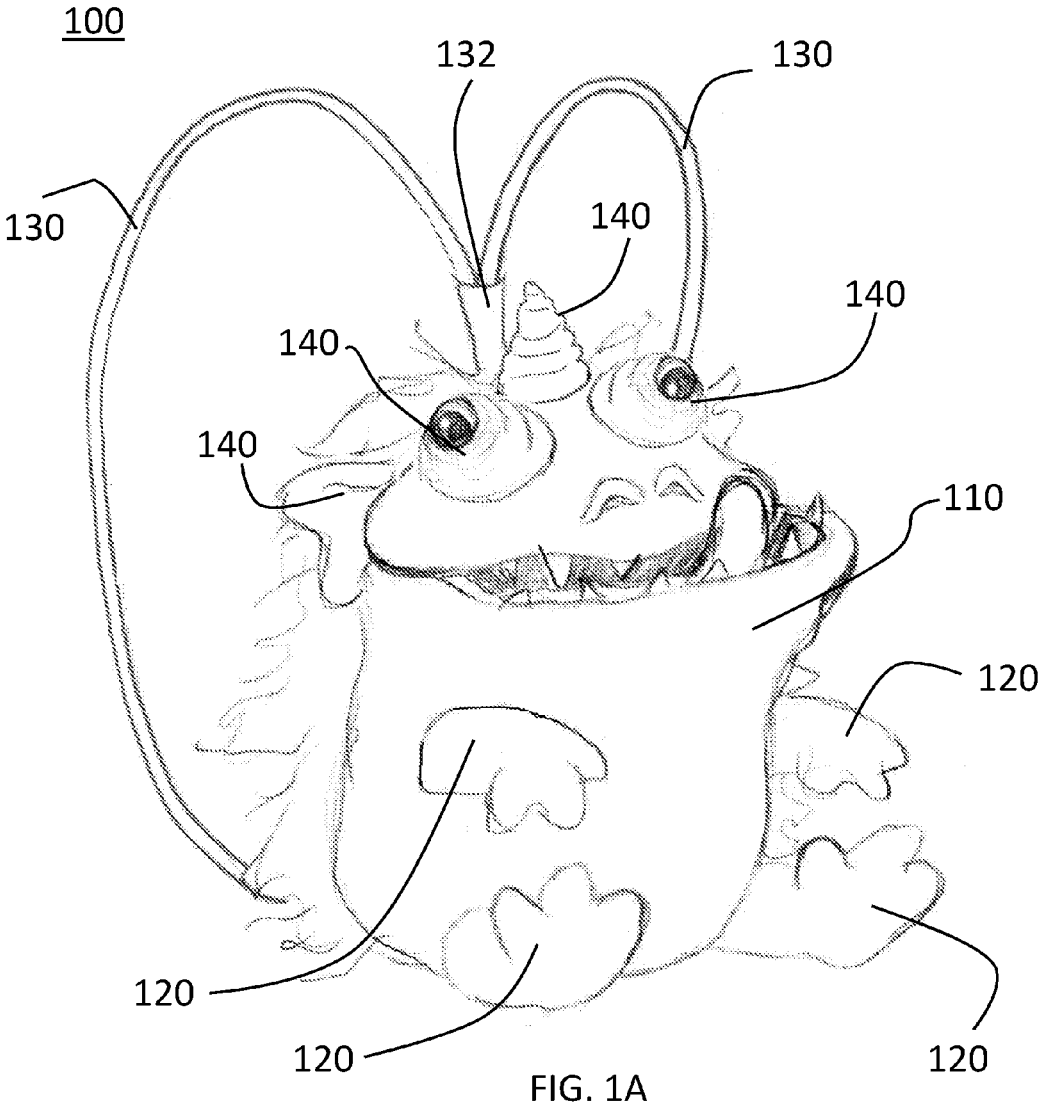
FIG. 1A is perspective view of a preferred embodiment of the present invention.
Figure 1B:
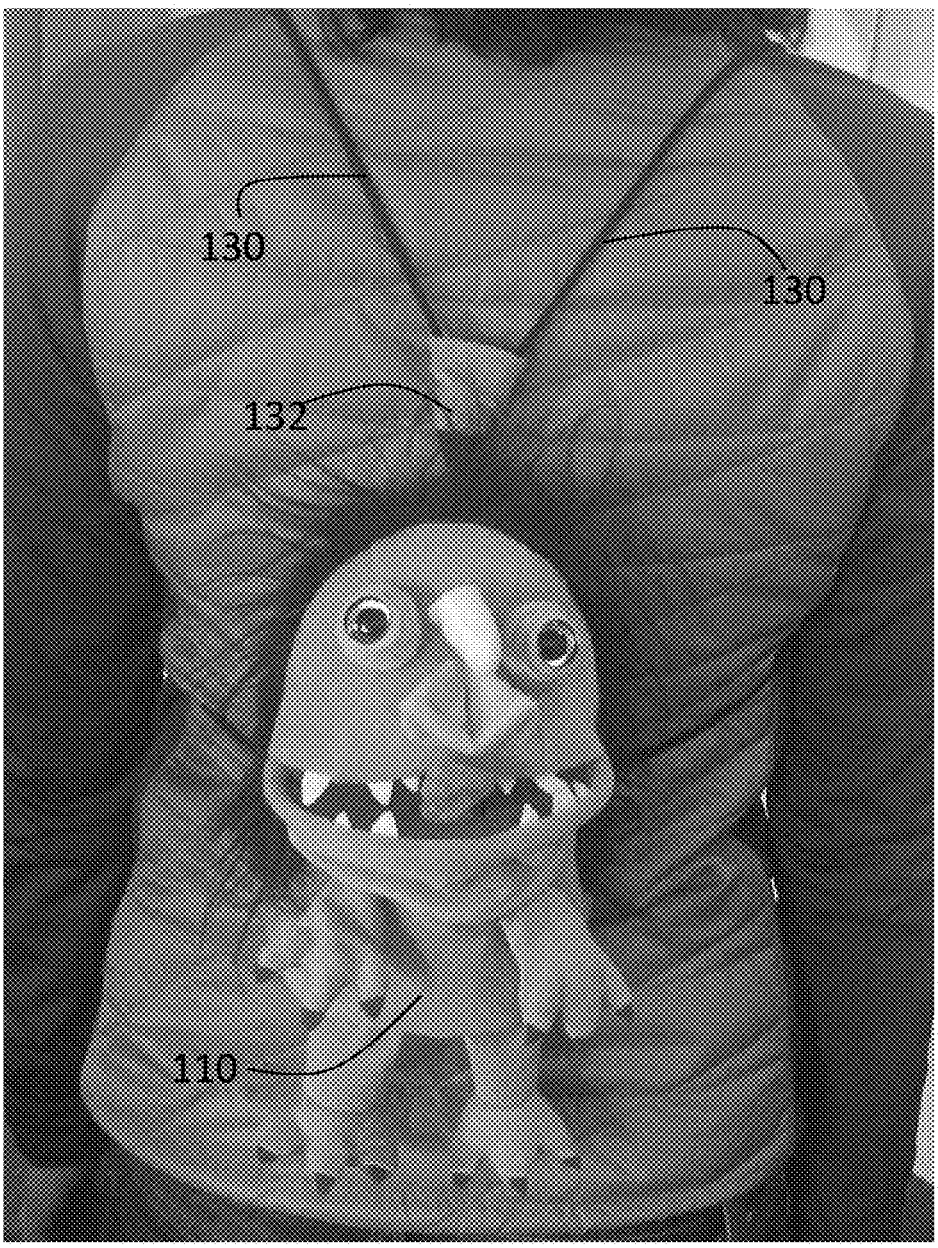
FIG. 1B is an image of a preferred embodiment of the present invention being worn by a user in a backpack configuration.
Figure 1C:
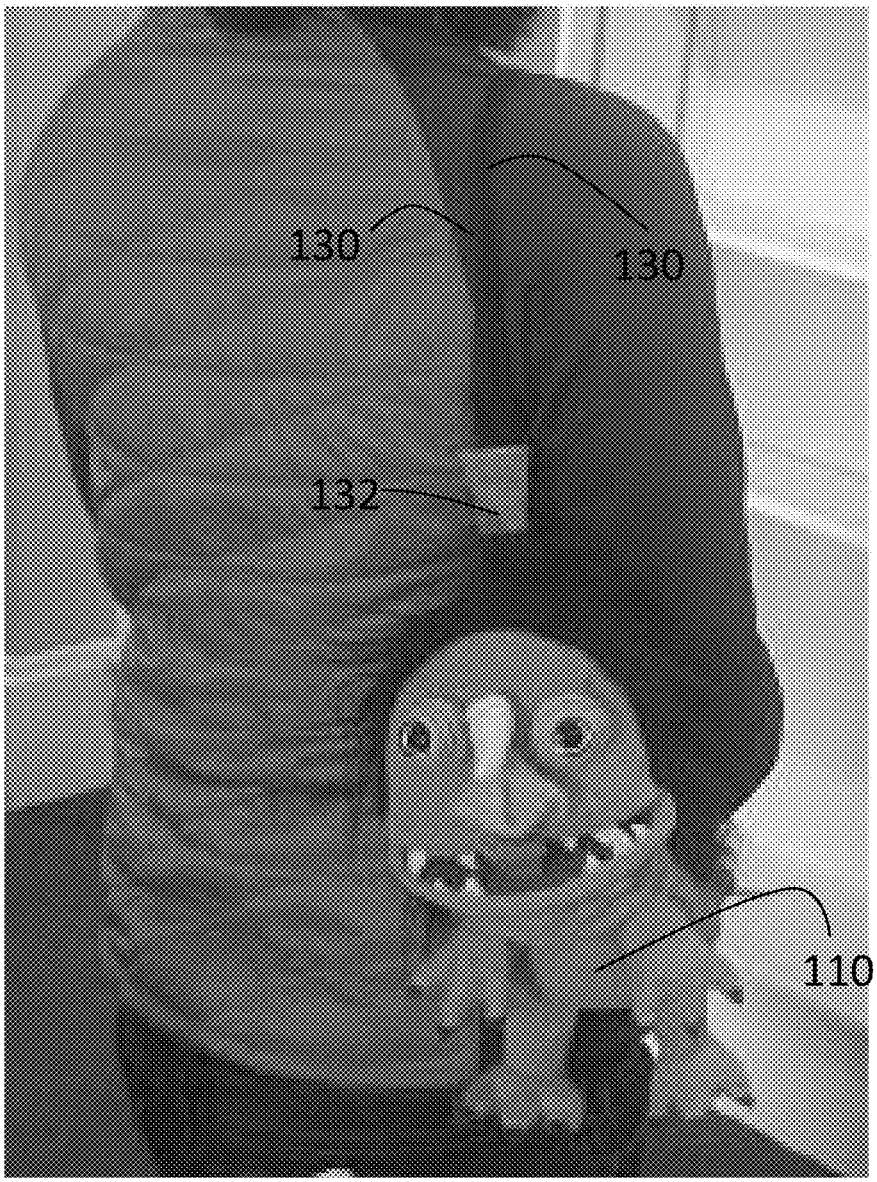
FIG. 1C is an image of a preferred embodiment of the present invention being worn by a user in a purse configuration.
Figure 1D:
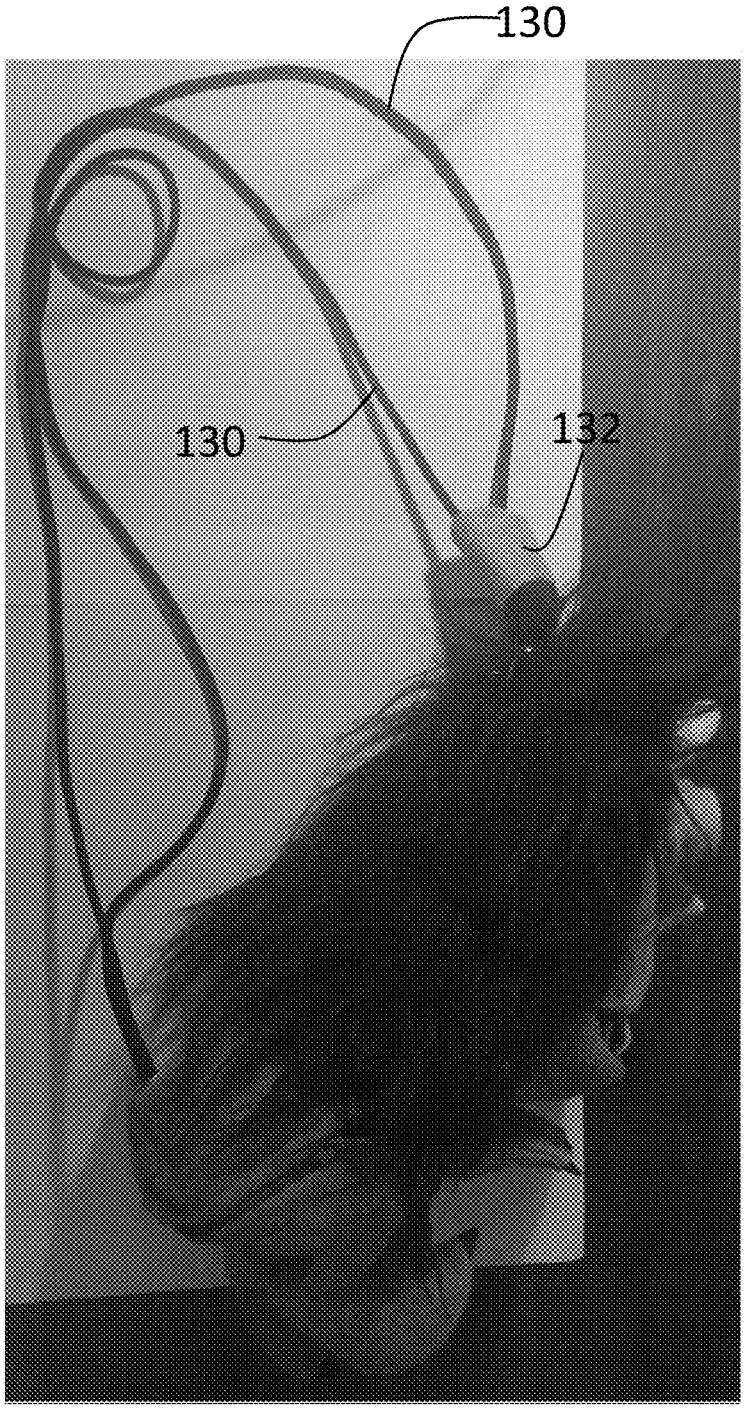
FIG. 1D is a side view of a preferred embodiment of the present invention with the tail extended and clipped to the receiving member on the exterior of the body.
Figure 1E:
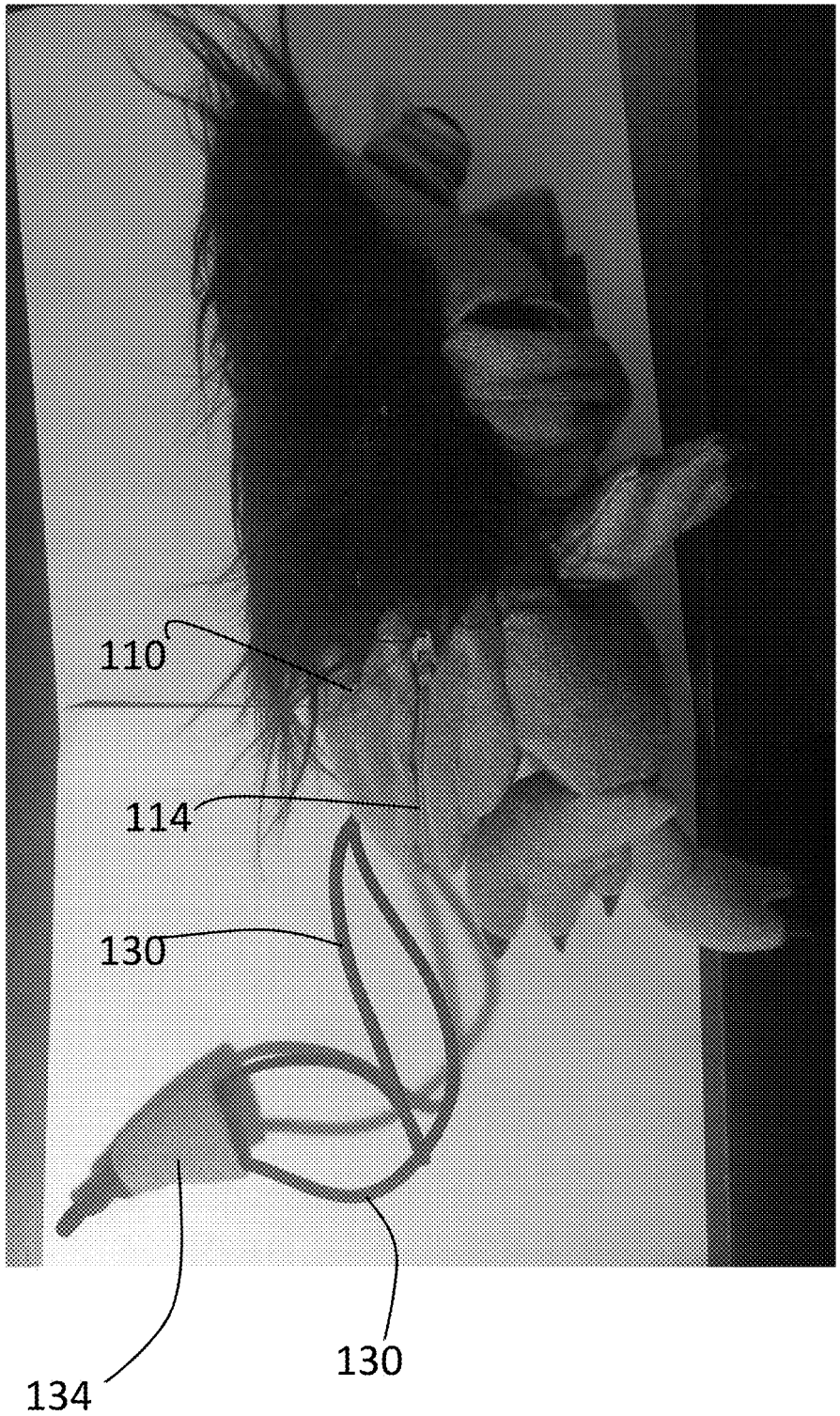
FIG. 1E is a side view of a preferred embodiment of the present invention with the tail partially retracted/partially extended from the body.
Figure 2:
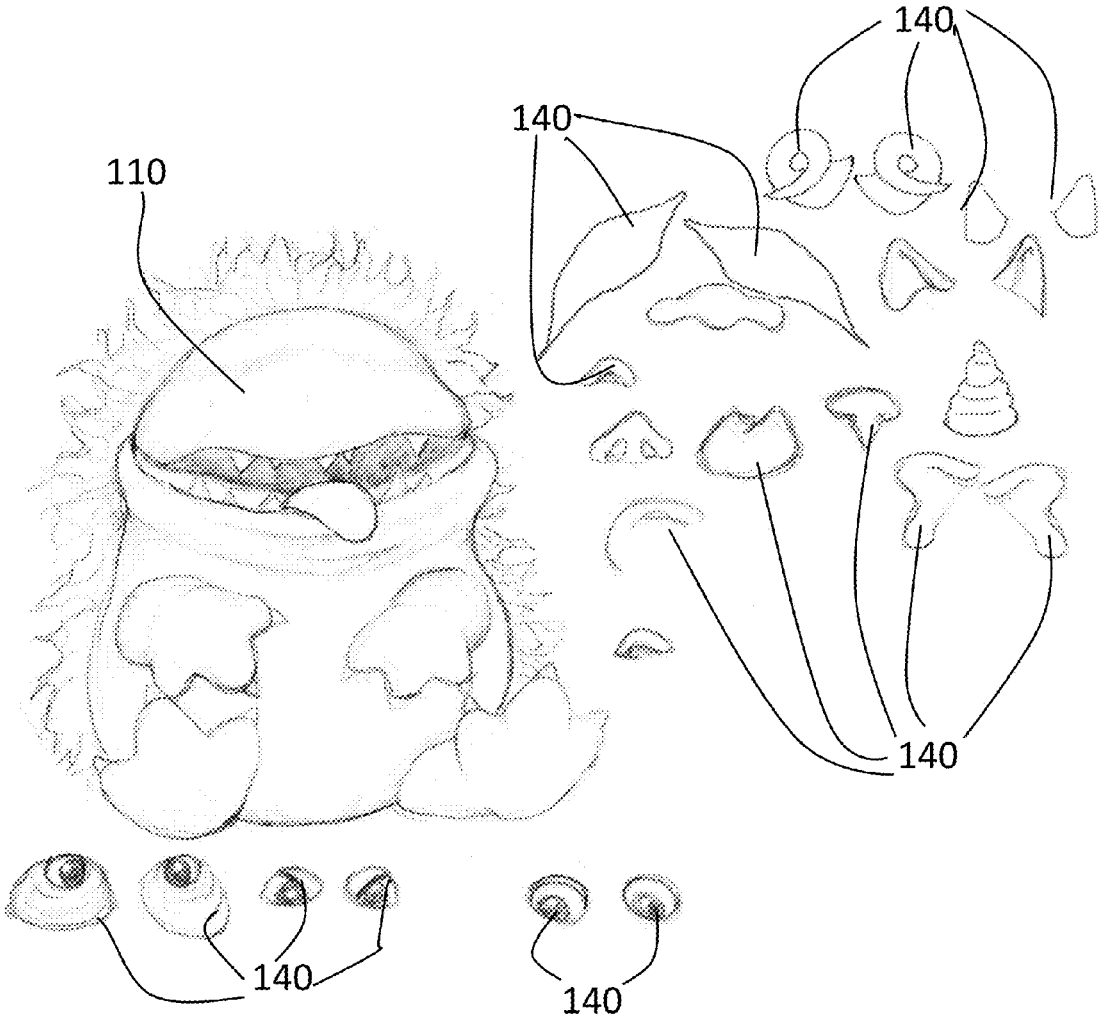
FIG. 2 is an assembly diagram illustrating the removable features of a preferred embodiment of the present invention.

The preferred embodiments of the inventions are described with reference to the drawings. As shown in FIG. 1A, a toy 100 in accordance with a preferred embodiment of the present invention has a body 110 having fixed legs 122, arms 124, mouth 126 and tongue 128. The legs, arms, mouth and tongue are fixed by known means, such as being sewn with thread. A variety of removable features 140 such as eyes, ears, noses, horns, eyebrows and others may be removably attached to the body 110, legs 122, arms 124, mouth 126 or tongue 128. In alternate embodiments, the legs 122, arms 124, mouth 126 and tongue 128 may be removably attached rather than being fixed to the body. The toy 100 has a tail having elongated straps 130, and tail member 132 and clip member 134 at or near the proximal end of the straps 130. The proximal ends of the elongated straps 130 extend through a hole or holes in the body 110 to the interior pocket or chamber 114 within the body 110. The proximal ends of the straps 130 are secured within the pocket 114 in some manner, such as with a knot in their proximal ends or a retention member fixed to their proximal ends. With the elongates straps extended outside the body 110 and the clip 134 attached to a receiving member on the body 110 as shown in FIG. 1D, the toy may be worn like a backpack as shown in FIG. 1B or a purse/bag as shown in FIG. 1C. If the clip 134 is released from the receiving member on the body 110, the elongated straps 130 may be retracted into the pocket within the body 110 partially as shown in FIG. 1E or completely such that only the tail member 132 and clip 134 remain exterior to the body. In alternative embodiments, the clip 134 may be reversed with the receiving member such that the receiving member is fixed to the distal end of the elongated straps and the clip is fixed to the body 110. As shown in FIG. 2, the features 140 are removable from the body 110 such that they may be mixed and matched or place and many or any location on the exterior of the body 110.

Figure 3A:
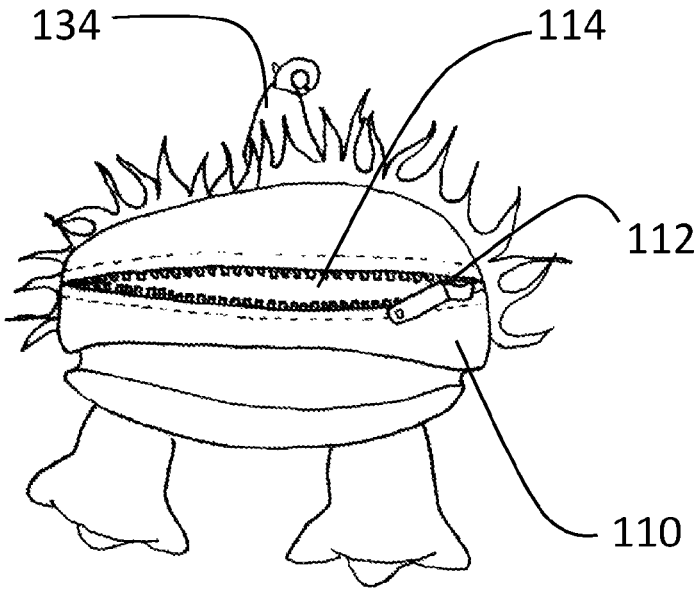
FIG. 3A is a bottom view of a preferred embodiment of the present invention with the pocket in the bottom of the body unzipped but closed.
Figure 3B:
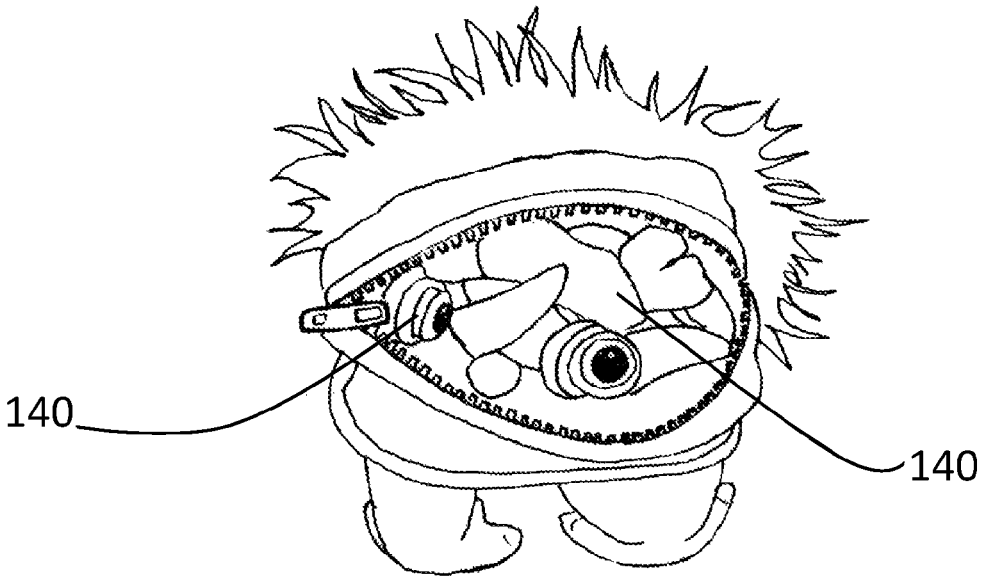
FIG. 3B is a bottom view of a preferred embodiment of the present invention with the pocket in the bottom of the body unzipped and open to reveal the removable featured stored within the pocket.

As shown in FIGS. 3A and 3B, the body 110 has a pocket 114 with a zipper 112. The pocket can be opened to pull the straps 130 into the pocket or to place features 140 inside the pocket. While a zipper 112 is shown in this preferred embodiment, it shall be understood by those of skill in the other that other closure means such as Velcro, snaps, buttons or any other known means may be used to close the pocket 114 to retain the features 140 within it. In yet another embodiment, the pocket 140 may not have any closure means and instead may be used to insert a hand in the manner of a puppet.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A toy comprising:

a plush toy body having a first connecting member on its exterior;

a pocket within said plush toy body, said pocket having an opening to provide a user access to said pocket from the exterior of said plush toy body;

a tail member having a proximal end and a distal end; and a pair of elongated straps each having a proximal end and a distal end, said elongated straps being extendable from said body and the proximal end of each strap extending through said tail member and through a hole within said body into an interior of said pocket and being secured within said pocket and the distal end of each elongated strap having a stop member and a second connecting member;

wherein in a first configuration said pair of elongated straps are extended from said body and said second connecting member is connected to said first connecting member and in a second configuration said first connecting member is disconnected from said second connecting member, said elongated straps are withdrawn into said pocket such that said proximal end of said tail member is adjacent said plush toy body and only said stop member and said second connecting member remain exterior to said plush toy body and exterior to said distal end of said tail member.

2. A toy according to claim 1 wherein said first connecting member is a clip.

3. A toy according to claim 1 wherein said second connecting member is a clip.

4. A toy according to claim 1 wherein said second connecting member is a loop formed in the end of one or both of said elongated straps.

5. The toy according to claim 1, wherein said plush toy body has an exterior surface, wherein at least one of a leg, an arm, a mouth and a tongue is fixed to said exterior surface of said plush toy body.

6. The toy according to claim 1, wherein a removable feature is removably attached to said plush toy body, where said removable feature on of an eye, an ear, a nose, a horn and an eyebrows.

7. The toy according to claim 1, wherein a removable feature is removably attached to said at least one of a leg, an arm and a mouth, where said removable feature on of an eye, an ear, a nose, a horn and an eyebrows.

8. The toy according to claim 1 further comprising means for closing said pocket.

9. The toy according to claim 8 further comprising a plurality of removable features in said pocket.

* * * * *